US009706824B2

(12) United States Patent
Tuning

(10) Patent No.: US 9,706,824 B2
(45) Date of Patent: Jul. 18, 2017

(54) HAT STORAGE DEVICE

(71) Applicant: Christopher Tuning, Brooklyn, NY (US)

(72) Inventor: Christopher Tuning, Brooklyn, NY (US)

( * ) Notice: Subject to any disclaimer, the term of this patent is extended or adjusted under 35 U.S.C. 154(b) by 0 days.

(21) Appl. No.: 14/933,038

(22) Filed: Nov. 5, 2015

(65) Prior Publication Data

US 2017/0127778 A1 May 11, 2017

(51) Int. Cl.

*A45C 11/02* (2006.01)
*A45C 13/10* (2006.01)
*A45C 13/30* (2006.01)

(52) U.S. Cl.

CPC ..... *A45C 11/02* (2013.01); *A45C 13/103* (2013.01); *A45C 13/1069* (2013.01); *A45C 13/30* (2013.01)

(58) Field of Classification Search

CPC ... A45C 2003/008; A45C 11/02; A45C 13/02; B65D 85/18
USPC ..... 206/8
See application file for complete search history.

(56) References Cited

U.S. PATENT DOCUMENTS 870,550 A * 11/1907 Dod ..... A45C 11/02 206/8
1,577,632 A * 3/1926 Coles ..... A45C 11/02 206/8
2,586,700 A * 2/1952 Noble ..... A45C 11/02 206/8
3,172,444 A * 3/1965 Frommelt ..... A61F 17/00 206/1.5
3,324,994 A * 6/1967 Rauser ..... A45C 11/02 206/756
5,022,515 A 6/1991 Agostine
5,074,410 A * 12/1991 Fries ..... B65D 85/18 190/117
5,480,023 A 1/1996 Puller
5,823,328 A * 10/1998 Fomby ..... A45C 11/02 190/13 G
5,865,013 A * 2/1999 Jackson ..... B65B 25/20 206/278
5,865,333 A * 2/1999 Wolfe ..... A42B 1/004 206/8
6,125,997 A * 10/2000 Campbell ..... A45C 11/02 206/278
6,167,569 B1 1/2001 Conner
D544,207 S 6/2007 Lindars
7,257,845 B1 8/2007 Conner
2005/0211574 A1 9/2005 Reeve
(Continued)

FOREIGN PATENT DOCUMENTS

GB 2464957 A * 5/2010 ..... A45F 5/06

*Primary Examiner* — Sue A Weaver
(74) *Attorney, Agent, or Firm* — The Law Firm of Andrea Hence Evans, LLC

(57) ABSTRACT

The invention features a storage device designed to protect and store caps. Multiple caps can be positioned in the storage device. The device is in the shape of a cap having an upper body portion and a lower body portion. The upper and lower body portions feature a closure mechanism which secures the upper and lower body portions together along their respective edges. A cap stopper is inside of the device and aids in preventing shifting of the caps. The cap stopper has a compartment sized to support miscellaneous items.

20 Claims, 4 Drawing Sheets

(56) References Cited

U.S. PATENT DOCUMENTS

| | | | | |
|---|---|---|---|---|
| 2012/0043229 | A1* | 2/2012 | Salys | A42B 3/006 206/8 |
| 2012/0145566 | A1* | 6/2012 | Hendricks | A42B 3/006 206/8 |

* cited by examiner

HAT STORAGE DEVICE

CROSS REFERENCE TO RELATED APPLICATION

This application claims the benefit of priority to U.S. Provisional Appl. No. 61/900,968, filed Nov. 6, 2013, and incorporated in its entirety herein.

FIELD

The present invention relates, in general, to systems and methods for protecting and storing hats.

BACKGROUND

Hats (e.g., baseball caps, bucket hats, berets, cricket caps, cowboy hats, top hats, and/or any other type of hat) can be relatively expensive. Thus, it can be desirable to keep them clean and in a wearable form to avoid undesired replacement. Storage racks can allow users to stack hats, but such storage racks typically cause the crown portions and/or brim portion of hats to deform. Also, exposing hats can attract lint and dust, which can be difficult to remove. Moreover, storage containers can be bulky and unreliable and may not be easily transported.

SUMMARY

Example embodiments described herein have innovative features, no single one of which is indispensable or solely responsible for their desirable attributes. Without limiting the scope of the claims, some of the advantageous features will now be summarized.

The present disclosure describes systems and methods for protecting and storing hats while the hats are being transported or not worn.

An aspect of an embodiment features a storage device in the shape of a hat, which aids in preventing the hat from being deformed. In some cases, the hat can be a cap (e.g., a baseball cap) having a crown portion that is configured to conform to the general shape of a person's head with a brim extending in a direction from the crown.

A further aspect of an embodiment features a closure mechanism, where the closure mechanism can extend around at least a portion of the brim of the storage device, as well as at least a portion of the crown area of the storage device. This closure mechanism can allow upper and lower body portions of the storage device to close and open with ease.

A further aspect of an embodiment features a cap stopper on the inside surface of the apparatus, which allows the caps to press against it so that the caps can easily form their original shape when removed from the storage device.

A further aspect of an embodiment features the cap stopper having a compartment which can receive and store additional items.

A further aspect of an embodiment features handles for transporting the storage device.

A further aspect of an embodiment features the storage device attached to a backpack for further storage of miscellaneous items.

Additional aspects, objectives, features and advantages of the present invention will become apparent from the following description of the preferred embodiments with reference to the attached drawings.

BRIEF DESCRIPTION OF THE DRAWINGS

Various embodiments are depicted in the accompanying drawings for illustrative purposes, and should in no way be interpreted as limiting the scope of the inventions. In addition, various features of different disclosed embodiments can be combined to form additional embodiments, which are part of this disclosure. Any feature or structure can be removed or omitted. Throughout the drawings, reference numbers can be reused to indicate correspondence between reference elements.

DETAILED DESCRIPTION

Although certain embodiments and examples are disclosed herein, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process can be performed in any suitable sequence and are not necessarily limited to any particular disclosed sequence. Various operations can be described as multiple discrete operations in turn, in a manner that can be helpful in understanding certain embodiments; however, the order of description should not be construed to imply that these operations are order dependent. Additionally, the structures described herein can be embodied as integrated components or as separate components. For purposes of comparing various embodiments, certain aspects and advantages of these embodiments are described. Not necessarily all such aspects or advantages are achieved by any particular embodiment. Thus, for example, various embodiments can be carried out in a manner that achieves or optimizes one advantage or group of advantages as taught herein without necessarily achieving other aspects or advantages as can also be taught or suggested herein.

Throughout this disclosure, reference will be made to hats and/or caps. This disclosure describes various embodiments relating to systems and methods for protecting and storing baseball caps, however, one having ordinary skill in the art can appreciate that those systems and methods can be readily adapted to other kinds of hats, including, but not limited to, bucket hats, berets, cricket caps, cowboy hats, top hats, and/or any other type of hat as desired.

Figure 1:
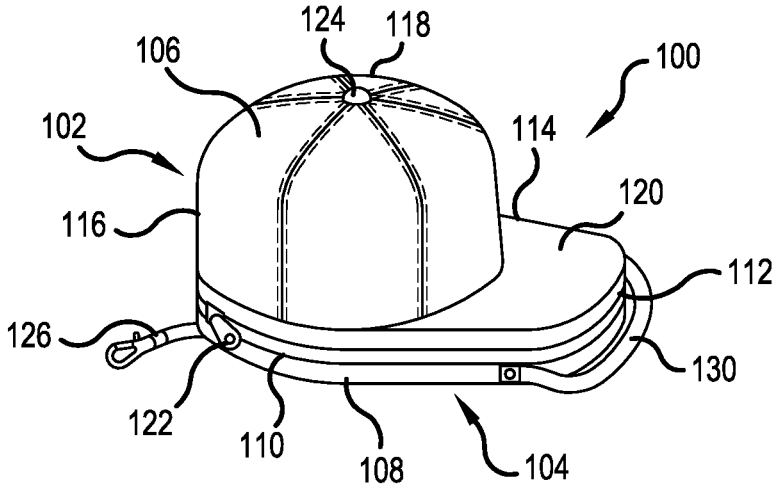
FIG. 1 is a perspective view of an example hat storage device.

FIG. 1 is a perspective view of an example hat storage device. Hat Storage Device 100 comprises Upper Body Portion 102 and Lower Body Portion 104. Hat Storage Device 100 can have a number of ends, including Front End 112, Bottom End 108, Right End 110, Left End 114, Back End 116, and Top End 118.

Hat Storage Device 100 can comprise materials including hard surface materials, such as, without limitation, aluminum, polycarbonate, ABS, polypropylene, plastic (e.g., fiber-reinforced polymers, polyethylene terephthalate, high-density polyethylene, polyvinyl chloride, low density polyethylene, polypropylene, polystyrene, and/or any other plastic), polymers (e.g., polythene, polypropylene, polyvinyl chloride, Teflon, polystyrene, bakelite, LEXAN, melamine, PERSPEX, vinyl rubber, neoprene, polystyrene-butadiene, and/or other polymers), ceramics (e.g., boron nitride, earthenware, porcelain, sialon, silicon carbide, steatite, titanium carbide, zirconia, and/or other ceramics), organics (e.g., wood, rubber, and/or other organics), and/or any other material. Desirably, in some embodiments, these materials have durable and sturdy qualities. Advantageously, this durability and sturdiness can help to prevent Hat Storage Device 100, and any hats and/or items stored within, from being stained or deformed. In some embodiments, the materials of the surface of Hat Storage Device 100 can be scratch- and dent-resistant. In some preferred embodiments, Crown Area 106 can comprise neoprene, which is a form of rubber, and Brim 120 can comprise dense foam board or chip board. Bottom End 108 can comprise a denser neoprene. And over top of any of the materials aforementioned, Hat Storage Device 100 can include an array of skins, fabrics, rubbers, or other coverings.

Upper Body Portion 102 can be the portion of Hat Storage Device 100 proximal to Top End 118, where Upper Body Portion 102 is separated from Lower Body Portion 104 by a closure mechanism such as a zipper. Alternate closure mechanisms may be substituted, including without limitation, snaps, pins, buttons, clasps, magnets, ties, laces, VELCRO, or other known closures. Inside Hat Storage Device 100 can be an inner storage cavity that is configured to store a hat. Upper Body Portion 102 can include Crown Area 106, which can be substantially similar in shape to the upper portion of a hat. For example, and, without limitation, where the hat is a baseball cap, Crown Area 106 can be substantially similar in shape to the crown of the cap, which can have a curved or substantially circular shape as illustrated by Hat Storage Device 100. The curved shape of the cap, and consequently Crown Area 106, can be configured to fit over the head of a person.

Extending distally from Crown Area 106 towards Front End 112 of Hat Storage Device 100 can be Brim 120. In some embodiments, Brim 120 can also extend distally from Crown Area 106 in another direction, including away from Bottom End 108, Right End 110, Left End 114, Back End 116, or Top End 118. Brim 120 can be configured in the shape of the brim of a cap, which can also be called the peak, beak, and other names of the cap. Typically, the brim of the cap is the stiff projection at the front that is configured to shade or shield a wearer's eyes from sun and rain. Brim 120 can cover the brim of the cap when the cap is in Hat Storage Device 100. When a plurality of caps are placed in Hat Storage Device 100 in a folded, stacked fashion where the crown area of the cap is folded and the brim of one cap is slid under the cap in front of it, Brim 120 can cover the brim of a first cap and a plurality of other caps. In some embodiments, Upper Body Portion 102 can include at least a portion of Brim 120. Handle 130, which can be configured for holding Hat Storage Device 100, can extend from Brim 120.

Crown Area 106 can include Top Button 124 and stitching designs to make Hat Storage Device 100 have an appearance substantially similar to a cap. Alternate designs can be added as desired to Crown Area 106 or elsewhere on Hat Storage Device 100, including Brim 120. These designs can include, without limitation, a variety of colors, personalized lettering, and other design styles or shapes. For example, and without limitations, team logos or corporate logos can be added and/or applied to Hat Storage Device 100.

Latch 126 can extend from Back End 116 or any other end, including Bottom End 108, Right End 110, Left End 114, Front End 112, or Top End 118. Latch 126 can be removable or permanently attached to Hat Storage Device 100. Latch 126 can be used to connect Hat Storage Device 100 to other devices, such as backpacks, purses, bags, clothing, hangers, racks, ropes, ties, or any other place as desired. Latch 126 can contain an actuating hooking/latching mechanism in some embodiments. Alternate latching mechanisms may be substituted, including without limitation, snaps, pins, buttons, clasps, magnets, ties, laces, VELCRO, or other known mechanisms for attachment.

Figure 2:
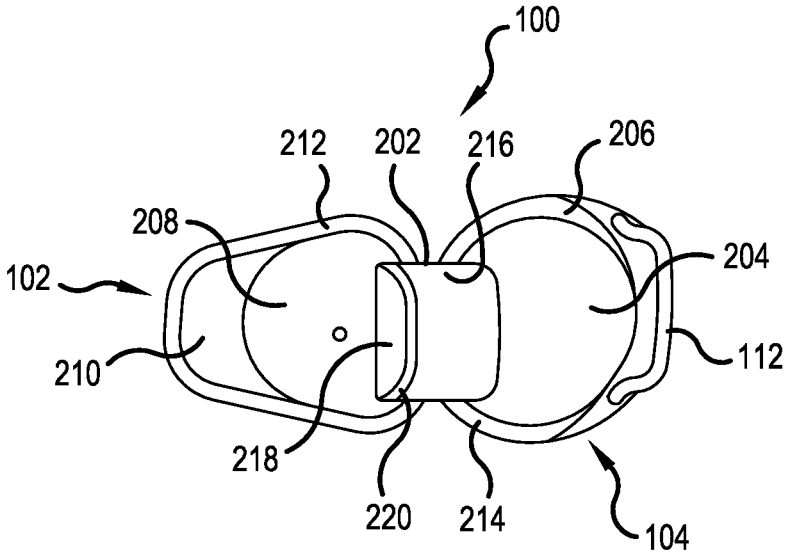
FIG. 2 is a top view of the example hat storage device from FIG. 1 in an open position.

FIG. 2 is a top view of the example hat storage device from FIG. 1 in an open position. Back End 116 (illustrated in FIG. 1) can include Hinge 202, which can connect Upper Body Portion 102 to Lower Body Portion 104. For example, and without limitation, Upper Body Portion 102 can rotate around Hinge 202 between approximately 0 degrees to approximately 180 degrees relative to Lower Body Portion 104. As desired, this range of motion can be restricted or extended. For example, and without limitation, Hinge 202 can be configured to only allow rotation of Upper Body Portion 102 between approximately 0 degrees to approximately 90 degrees, or some other degree between approximately 0 degrees and approximately 180 degrees. In some embodiments, Upper Body Portion 102 can rotate around Hinge 202 at a degree greater than approximately 180 degrees relative to Lower Body Portion 104 as desired.

Lower Body Portion 104 can act as the base or bottom portion of Hat Storage Device 100. Lower Body Portion 104 can align with Upper Body Portion 102 such that the bottom area of a cap placed in Hat Storage Device 100 can rest against Interior Surface 204 of Lower Body Portion 104. Upper Body Portion 102, with Interior Surface 208, can cover the top of the cap. Lower Body Portion 104 can include Lower Wall 206, which can be positioned along the perimeter of Lower Body Portion 104. Lower Wall 206 can extend distally from Bottom End 108 towards Upper Body Portion 102. Lower Wall 206 can be configured to surround the brim and lower portion of a cap placed in Hat Storage Device 100. For example, and without limitation, Lower Wall 206 can be positioned along the perimeter of Lower Body Portion 104 such that Lower Wall 206 forms a closed loop around substantially the entire perimeter of Lower Body Portion 104. In other embodiments, Lower Wall 206 may not form a closed loop and can cover a portion of Lower Body Portion 104. In some embodiments, Lower Wall 206 can attach to Hinge 202.

In some embodiments, Lower Body Portion 104 can include at least a portion of Brim 120. In some embodiments, Lower Body Portion 104 can include at least a portion of Crown Area 106.

First Zipper Track 212 can extend around the bottom edge of Upper Body Portion 102. In some embodiments, because First Zipper Track 212 is along the bottom edge of Upper Body Portion 102, it can be located along the perimeters of Crown Area 106, Brim 120, and/or other portions of Upper Body Portion 102.

Similarly, Second Zipper Track 214 can extend around the top edge of Lower Body Portion 104. In some embodiments, because Second Zipper Track 214 is along the top edge of Lower Body Portion 104, it can be located along the perimeters of Crown Area 106, Brim 120, and/or other portions of Lower Body Portion 104.

First Zipper Track 212 and Second Zipper Track 214 can include teeth. Zipper Slide 122 can be configured move along each of First Zipper Track 212 and Second Zipper Track 214. Zipper Slide 122 can comprise two slots, one for First Zipper Track 212 and one for Second Zipper Track 214. When Zipper Slide 122 engages both First Zipper Track 212 and Second Zipper Track 214 simultaneously, it can engage First Zipper Track 212 and Second Zipper Track 214 together and apart as it moves along (e.g., forward or back) First Zipper Track 212 and Second Zipper Track 214. In this way, the teeth of First Zipper Track 212 and Second Zipper Track 214 can interlock and form a secure bond to close Hat Storage Device 100. Alternate securing mechanisms may be substituted, including without limitation, snaps, pins, buttons, clasps, magnets, ties, laces, VELCRO, or other known secures.

Cap Stopper 216 can be positioned proximally to Back End 116 and abutted to Interior Surface 204 and/or Interior Surface 208. Cap Stopper 216 can allow a cap in Hat Storage Device 100 to rest its back area against the surface of Cap Stopper 216 facing Front End 112 so that the back area of the cap contacts Cap Stopper 216. When the cap is removed from Cap Stopper 216 and placed on the wearer's head, the cap can regain its shape. Cap Stopper 216 can allow the caps in Hat Storage Device 100 to be aligned in a horizontal direction. In some embodiments, about 10-12 caps may be stored in Hat Storage Device 100 at one time, but the size of Hat Storage Device 100 can be configured to store fewer or greater than 10-12 caps as desired.

Cap Stopper 216 can be a cylindrical shape and non-deformable to add pressure against the back of a cap in Hat Storage Device 100. Cap Stopper 216 can have an internal compartment that can be used to store miscellaneous items within. In some embodiments, the internal compartment can be accessed by opening Cover 218, which can be affixed to Cap Stopper 216 with a closing mechanism such as Zipper 220. Alternate closure mechanisms may be substituted, including without limitation, snaps, pins, buttons, clasps, magnets, ties, laces, VELCRO, or other known closures. In some embodiments, the closing mechanism can only be accessed after opening Hat Storage Device 100. In other embodiments, the closing mechanism can be accessed by a user whether or not Hat Storage Device 100 is open or closed (e.g., the closing mechanism can be externally accessible). In some embodiments, Cap Stopper 216 can be permanently affixed to Hat Storage Device 100 or removable so that the user can use Cap Stopper 216 to transport and store other items.

Figure 3:
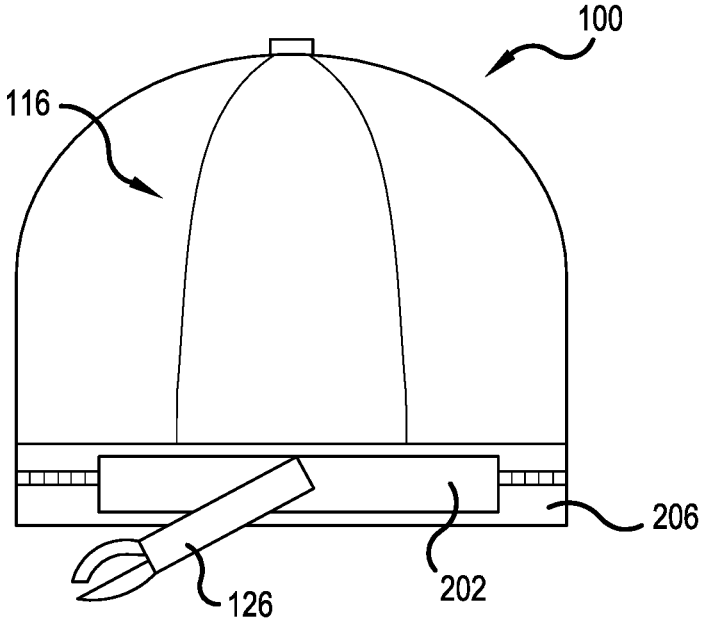
FIG. 3 is a back view of the example hat storage device from FIG. 1 in a closed position.

FIG. 3 is a back view of the example hat storage device from FIG. 1 in a closed position. In this example embodiment, Latch 126 is illustrated as attached to Hinge 202.

In some embodiments, where Lower Wall 206 forms a closed or substantially closed loop, Hinge 202 can connect to Lower Wall 206 proximal to Back End 116. In other embodiments, Lower Wall 206 may not be a closed loop around substantially the entire perimeter of Lower Body Portion 104, and Lower Wall 206 can have an opening where Hinge 202 is located. In some cases, Lower Wall 206 can then connect to Hinge 206 and Hinge 206 can connect to Interior Surface 204 and/or Bottom End 108. Latch 126 can be positioned anywhere on Hat Storage Device 100 as desired.

In other embodiments, Hat Storage Device 100 may not have Hinge 206, and Lower Body Portion 104 can be completely detached from Upper Body Portion 102.

Figure 4:
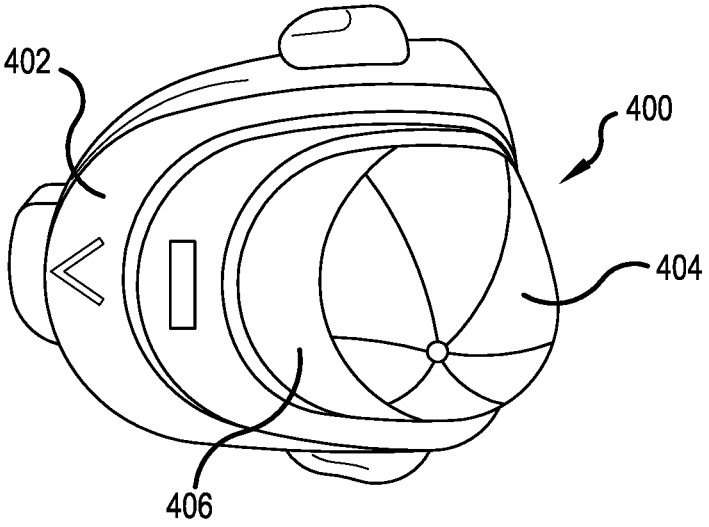
FIG. 4 is a perspective view of an example hat storage device connected to a backpack.

FIG. 4 is a perspective view of an example hat storage device connected to a backpack. Hat Storage Device 400 comprises Crown Area 404 and Brim 406. Backpack 402 can be any sort of bag configured to be carried on users' backs. In other embodiments, instead of Backpack 402, Hat Storage Device 400 can connect to any other bag, including, but not limited to, purses, duffle bags, luggage bags, tote bags, messenger bags, etc.

Hat Storage Device 400 can be permanently affixed to Backpack 402 or it can be removable. For example, and without limitation, the bottom surface of Hat Storage Device 400 (e.g., the surface proximally located to Backpack 402) can comprise a connection mechanism that connects Hat Storage Device 400 to Backpack 402. Examples of connection mechanisms include, but are not limited to, buttons, snaps, or magnets that can connect to openings, receivers or magnets to hold Hat Storage Device 400 in place on Backpack 402.

Figure 5:
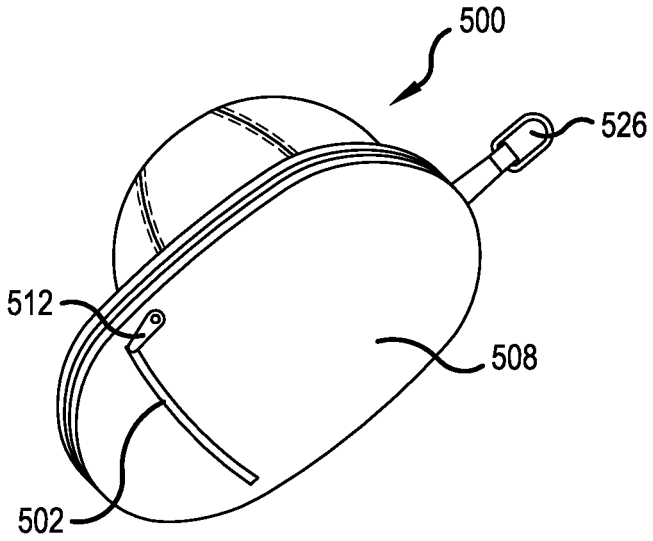
FIG. 5 is a bottom view of an example hat storage device having an example pocket and latching mechanism.

FIG. 5 is a bottom view of an example hat storage device having an example pocket and latching mechanism. Bottom End 508 of Hat Storage Device 500 can include an opening in the form of Pocket 502. A closure mechanism can be used to close Pocket 502. For example, and without limitation, Pocket 502 can include Zipper 512. Other, alternate closure mechanisms may be substituted, including snaps, pins, buttons, clasps, magnets, ties, laces, VELCRO, or other known closures. Hat Storage Device 500 can also include a latching mechanism, such as Latch 526, which can be substantially similar to Latch 126 described with reference to FIG. 1 and FIG. 3. Latch 526 can latch Hat Storage Device 500 onto a belt loop, duffle bag, backpack, or any other bag or apparatus described in this disclosure. Latch 526 can extend from the back end of Hat Storage Device 500 between the upper and lower body portions. In other embodiments, Latch 526 can be positioned anywhere on Hat Storage Device 500 as desired.

Figure 6:
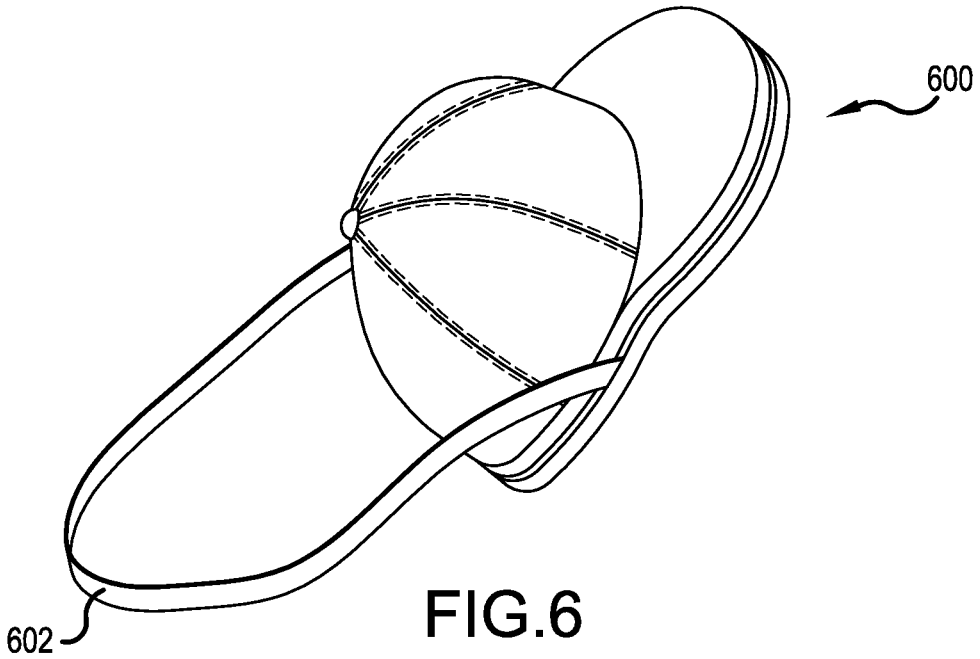
FIG. 6 is a perspective view of an example hat storage device having a shoulder strap.

FIG. 6 is a perspective view of an example hat storage device having a shoulder strap. The ends of Strap 602 can be connected to Hat Storage Device 600 around the middle area of the lower body portion. Strap 602 can be connected to form a loop or opening where a user can carry Hat Storage Device 600 around his/her shoulder.

Figure 7:
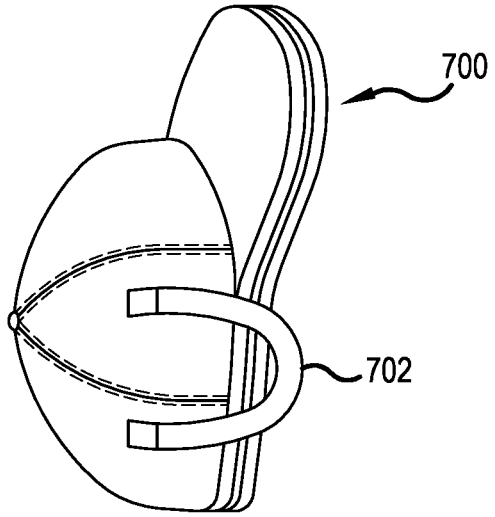
FIG. 7 is a perspective view of an example hat storage device having straps on its upper body.

One or more straps can be connected to a hat storage device. FIG. 7 is a perspective view of an example hat storage device having straps on its upper body portion. In some embodiments, two straps can be connected to the upper body portion of Hat Storage Device 700. Strap 702 can be secured to the right end of the crown of Hat Storage Device 700 and a second strap (not pictured) can be secured to the left side of the crown of Hat Storage Device 700. As shown in FIG. 7, the straps (e.g., Strap 702) can hang in a downward position. However, a user can grip the straps and they can move upwards and allow the device to be easily transported. The straps can act as handles to provide easy gripping and transporting of Hat Storage Device 700.

Figure 8:
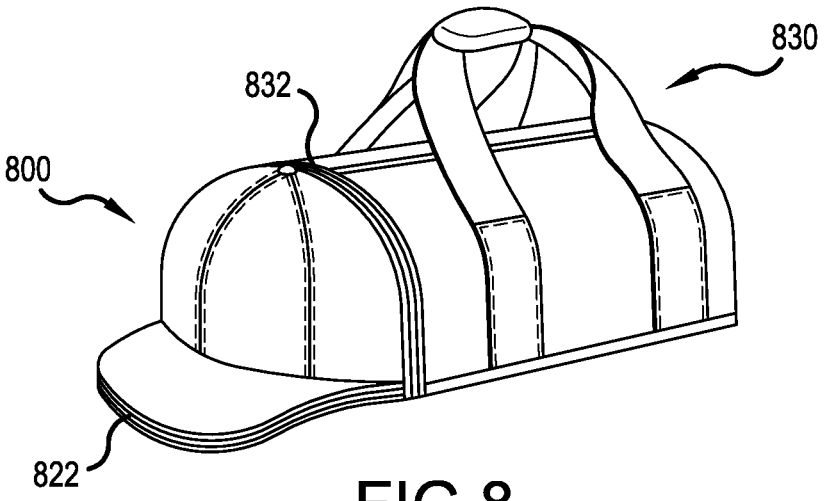
FIG. 8 is a perspective view of an example hat storage device connected to a duffle bag.

FIG. 8 is a perspective view of an example hat storage device connected to a duffle bag. Hat Storage Device 800 has Zipper Slides 832, located at the top end of Hat Storage Device 800. Zipper Slides 832 can run on zipper tracks that interface Hat Storage Device 800 with Duffle Bag 830. These zipper tracks can comprise teeth that can interlock similar to First Zipper Track 212 and Second Zipper Track 214 described with reference to FIG. 2. Zipper Slides 832 can comprise a plurality of zipper slides. In some embodiments, Zipper Slides 832 can include two zipper slides, which are a left zipper slide and a right zipper slide. In the closed position, the left and right zipper slides meet together along the zipper tracks. To open the top of Hat Storage Device 800, a user can start pulling the left and right zipper slides and zip around so that each the left and right zipper slides move towards the brim of Hat Storage Device 800. The zipper tracks of Zipper Slides 832, connected to the edge of a panel of Duffle Bag 830, unzip along the crown and meet at the left and right edge of the brim. Accordingly, in the fully open position, both left and right zipper slides of Zipper Slides 832 can be at the brim of Hat Storage Device 800. Hat Storage Device 800 can be secured to a panel on the Duffle Bag 830 by the back area (e.g., the back of the crown area or brim) of Hat Storage Device 800. Hat Storage Device 800 can be permanently or removably attached to Duffle Bag 830. In some embodiments, Hat Storage Device 800 can be separated from Duffle Bag 830 without unzipping Zipper Slides 832. In other embodiments, Zipper Slides 832 and their zipper tracks can be used to hold and remove Hat Storage Device 800 from Duffle Bag 830. Connected to Duffle Bag 830, Hat Storage Device 800 can open by unzipping Zipper Slides 832, leaving the brim attached to the duffle bag, so that items can be placed inside of the crown area of the device for storage.

In some embodiments, Hat Storage Device 800 can open and close along its brim using Zipper 822. This opening can allow access to caps stored in Hat Storage Device 800 and other items stored in the brim.

In some embodiments, the zipper tracks of Zipper Slides 832 and Zipper 822 are separate zipper systems that cannot cross over to each other. In other embodiments, Zipper Slides 832 and Zipper 822 can be connected so that they run on a continuous track. In this way, the left and right Zipper Slides of Zipper Slides 832 can unzip all the way to the brim of Hat Storage Device 800 and open and close Hat Storage Device 800 fully.

The invention has been described in detail with particular reference to certain preferred embodiments thereof, but it will be understood that variations and modifications can be effected within the spirit and scope of the invention.

What is claimed is:

1. A hat storage system comprising:

a storage body in a shape of a baseball cap having an inner storage cavity, wherein the storage body has an upper body portion, a lower body portion, a brim, and a crown area;

a cap stopper distally located from the brim in the crown area, the cap stopper having a cylindrical shape configured to add a pressure against the back of a cap placed in the inner storage cavity; and a closure mechanism configured to connect the upper body portion to the lower body portion.

2. The hat storage system of claim 1, wherein the closure mechanism is selected from the group consisting of zippers, snaps, pins, buttons, clasps, magnets, ties, laces, and VELCRO.

3. The hat storage system of claim 1, further comprising a latch extending from the crown area.

4. The hat storage system of claim 1, wherein the cap stopper has an internal compartment.

5. The hat storage system of claim 4, wherein the internal compartment includes a cover connected to the cap stopper by a cover closure mechanism.

6. The hat storage system of claim 1, wherein the upper body portion comprises at least a portion of the brim and crown area.

7. The hat storage system of claim 1, wherein the lower body portion comprises at least a portion of the brim and crown area.

8. The hat storage system of claim 1, wherein the upper body portion includes a strap configured to form a loop for carrying.

9. A hat storage system comprising:

a storage body in a shape of a baseball cap having an inner storage cavity, wherein the storage body has an upper body portion, a lower body portion, a brim, and a crown area;

a cap stopper distally located from the brim in the crown area, the cap stopper attached to an interior surface of the storage body and configured to add a pressure against the back of a cap placed in the inner cavity; and a closure mechanism configured to connect the upper body portion to the lower body portion.

10. The hat storage system of claim 9, wherein the closure mechanism is selected from the group consisting of zippers, snaps, pins, buttons, clasps, magnets, ties, laces, and VELCRO.

11. The hat storage system of claim 9, further comprising a latch extending from the crown area.

12. The hat storage system of claim 9, wherein the cap stopper has an internal compartment.

13. The hat storage system of claim 12, wherein the internal compartment includes a cover connected to the cap stopper by a cover closure mechanism.

14. The hat storage system of claim 9, wherein the upper body portion comprises at least a portion of the brim and crown area.

15. The hat storage system of claim 9, wherein the lower body portion comprises at least a portion of the brim and crown area.

16. The hat storage system of claim 9, wherein the upper body portion includes a strap configured to form a loop for carrying.

17. A hat storage system comprising:

a storage body in a shape of a baseball cap having an inner storage cavity, wherein the storage body has an upper body portion, a lower body portion, a brim, and a crown area;

a cap stopper distally located from the brim in the crown area, the cap stopper having a cylindrical shape configured to add a pressure against the back of a cap placed in the inner cavity; and a closure mechanism configured to connect the storage body to a duffle bag.

18. The hat storage system of claim 17, wherein the closure mechanism is selected from the group consisting of zippers, snaps, pins, buttons, clasps, magnets, ties, laces, and VELCRO.

19. The hat storage system of claim 17, wherein the cap stopper has an internal compartment.

20. The hat storage system of claim 19, wherein the internal compartment includes a cover connected to the cap stopper by a cover closure mechanism.

* * * * *